US006926467B1

(12) United States Patent
Andersen et al.

(10) Patent No.: US 6,926,467 B1
(45) Date of Patent: Aug. 9, 2005

(54) METHOD AND DEVICE FOR REPLACING EQUIPMENT ON THE SEABED

(75) Inventors: Tore Andersen, Oslo (NO); Stein Tore Haavimb, Kongsberg (NO); Joren Breda, Nesoya (NO); Atle Rangnes, Asker (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 69 days.

(21) Appl. No.: 10/111,590

(22) PCT Filed: Oct. 27, 2000

(86) PCT No.: PCT/NO00/00358

§ 371 (c)(1),
(2), (4) Date: Apr. 26, 2002

(87) PCT Pub. No.: WO00/31166

PCT Pub. Date: May 3, 2001

(30) Foreign Application Priority Data

Oct. 29, 1999 (NO) ..... 19995285

(51) Int. Cl.[7] ..... B63C 11/52; E21B 41/04
(52) U.S. Cl. ..... 405/191; 166/339; 166/352

(58) Field of Search ..... 405/190, 191, 405/303; 414/142.8, 662, 803; 166/338, 166/339, 341, 352

(56) References Cited

U.S. PATENT DOCUMENTS

| | | | | |
|---|---|---|---|---|
| 3,638,722 A | | 2/1972 | Talley, Jr. | |
| 4,167,215 A | | 9/1979 | Thorne | |
| 4,630,542 A | * | 12/1986 | Peyre et al. | 414/139.6 |
| 4,768,984 A | | 9/1988 | de Oliveira et al. | |
| 4,784,525 A | * | 11/1988 | Francois | 405/190 |

FOREIGN PATENT DOCUMENTS

| | | |
|---|---|---|
| NO | 166890 | 9/1991 |

* cited by examiner

*Primary Examiner*—Michael Safavi
(74) *Attorney, Agent, or Firm*—Young & Thompson

(57) ABSTRACT

A device (20) for replacing equipment, i.e. modules on an installation (10) on the seabed. The device comprises a box-shaped buoyancy element which has storage spaces (25) for equipment together with winch devices (22) assigned to each storage space. During use the device is lowered from a vessel (1) to the seabed by a crane (3), but is stopped a distance from the installation, whereupon the locally provided winches (22) are used to pull up and position the equipment.

3 Claims, 3 Drawing Sheets

METHOD AND DEVICE FOR REPLACING EQUIPMENT ON THE SEABED

BACKGROUND OF THE INVENTION

The invention relates to a method and a device for replacing equipment on the seabed.

Equipment which is placed on the seabed in connection with extraction of hydrocarbons from deposits found at sea may require replacement or retrieval for maintenance purposes or because the equipment fails after a period of time.

For replacement, the equipment has to be brought up to the surface. For this purpose a pipe string or wires/chains may be employed. If the object which has to be retrieved is very heavy, a pipe string is normally used. In this case a rig or drilling vessel with a derrick is employed. However, vessels of this kind are extremely expensive. If it is possible, therefore, the use is preferred of smaller vessels equipped with a crane. The equipment is then lowered by means of a wire, chain or the like.

A disadvantage of the present methods is that heave compensator systems have to be used. A vessel floating on the water will be exposed to wind an weather as well as wave motion. Waves cause the vessel to move vertically relative to the seabed, which may result in damage to the equipment during the operation. Heave compensator systems compensate for heave or wave motion. Such systems therefore ensure that the pipe string or the wire, and thereby the equipment, are kept reasonably stationary relative to the seabed. There are two main types of heave compensator systems, an active type and a passive type.

A second disadvantage of the present methods is that replacement of equipment normally has to be undertaken in several stages. Firstly, the retrieval device has to be lowered to get hold of the equipment which is to be replaced. This has to be brought up to the surface, whereupon the new equipment can be lowered and placed in position. This takes time and therefore is costly.

From U.S. Pat. No. 4,167,215 a device is known for replacing equipment on the seabed. The device comprises a store for storing equipment. This means that the device can take new equipment down, thus enabling it to be replaced by the equipment on the installation without the need for several trips up and down. However, the device is complicated and is dependent on accurate positioning or alignment of the device relative to the installation on the seabed. The seabed installation also has to be prepared for this by having receiving and orientating bodies for the device.

SUMMARY OF THE INVENTION

Thus, there is a need for equipment which can both be used by means of a smaller vessel and which can reduce the time it takes to replace equipment on an installation on the seabed. With the invention according to the application, a simpler and less expensive system has been produced for performing such operations. The equipment eliminates the need for expensive heave compensator systems, thereby making it possible to use a smaller (and less expensive) vessel for the work.

BRIEF DESCRIPTION OF THE DRAWINGS

The invention will now be described with reference to the drawings, in which.

DESCRIPTION OF THE PREFERRED EMBODIMENTS

Figures 1, 2, 3, 4, 5:
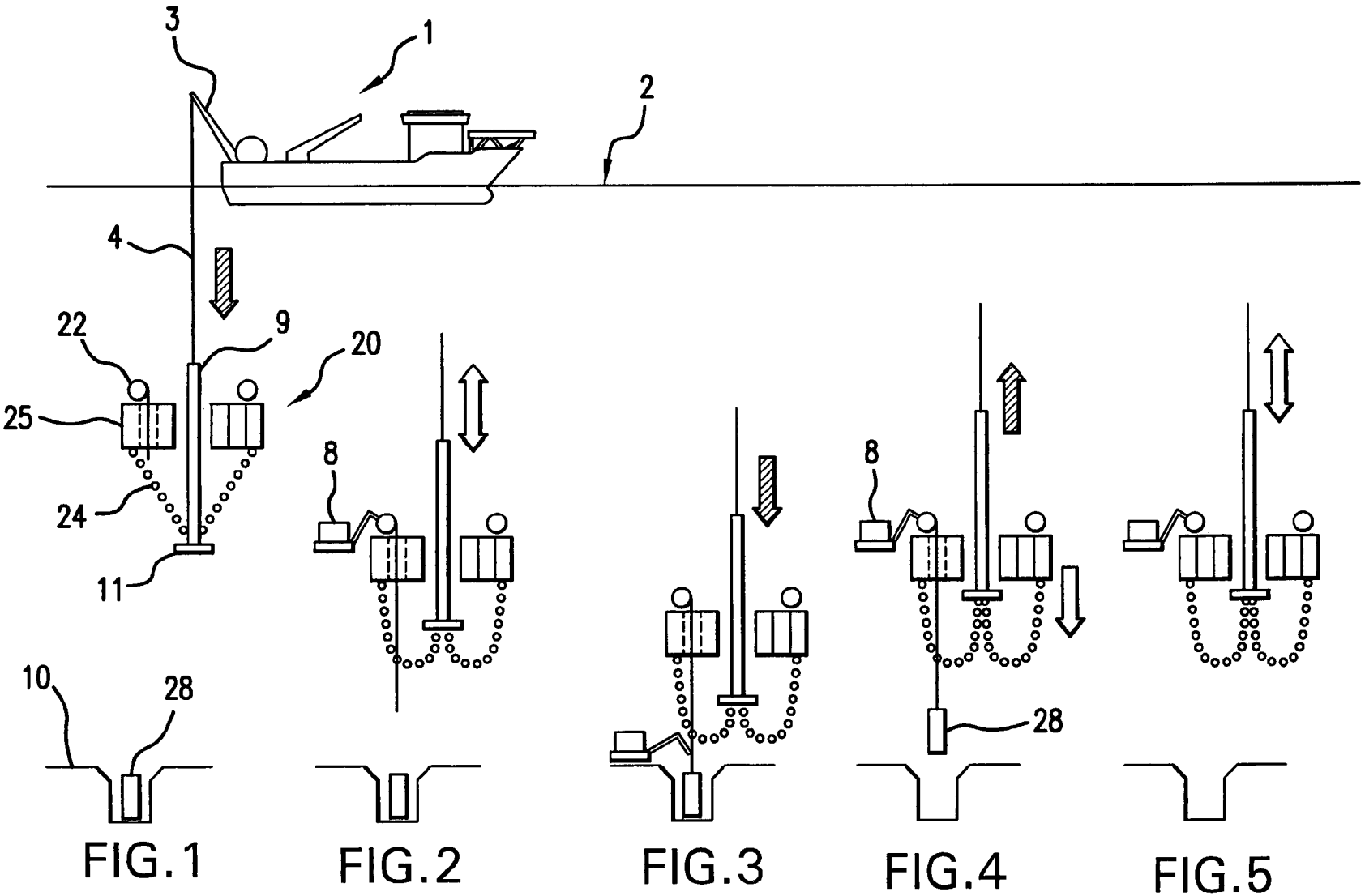
FIGS. 1–8 are schematic views illustrating the stages in the method.

FIG. 1 shows a vessel 1 floating on the water 2. The vessel is equipped with a crane 3 as well as other equipment which may be necessary for carrying out work in connection with the implementation of the invention.

The crane 3 can pay out and pull in a wire 4. The device 20 is intended to be fastened to the wire 4 to enable it to be raised and lowered by means of the crane 3.

Figure 9:
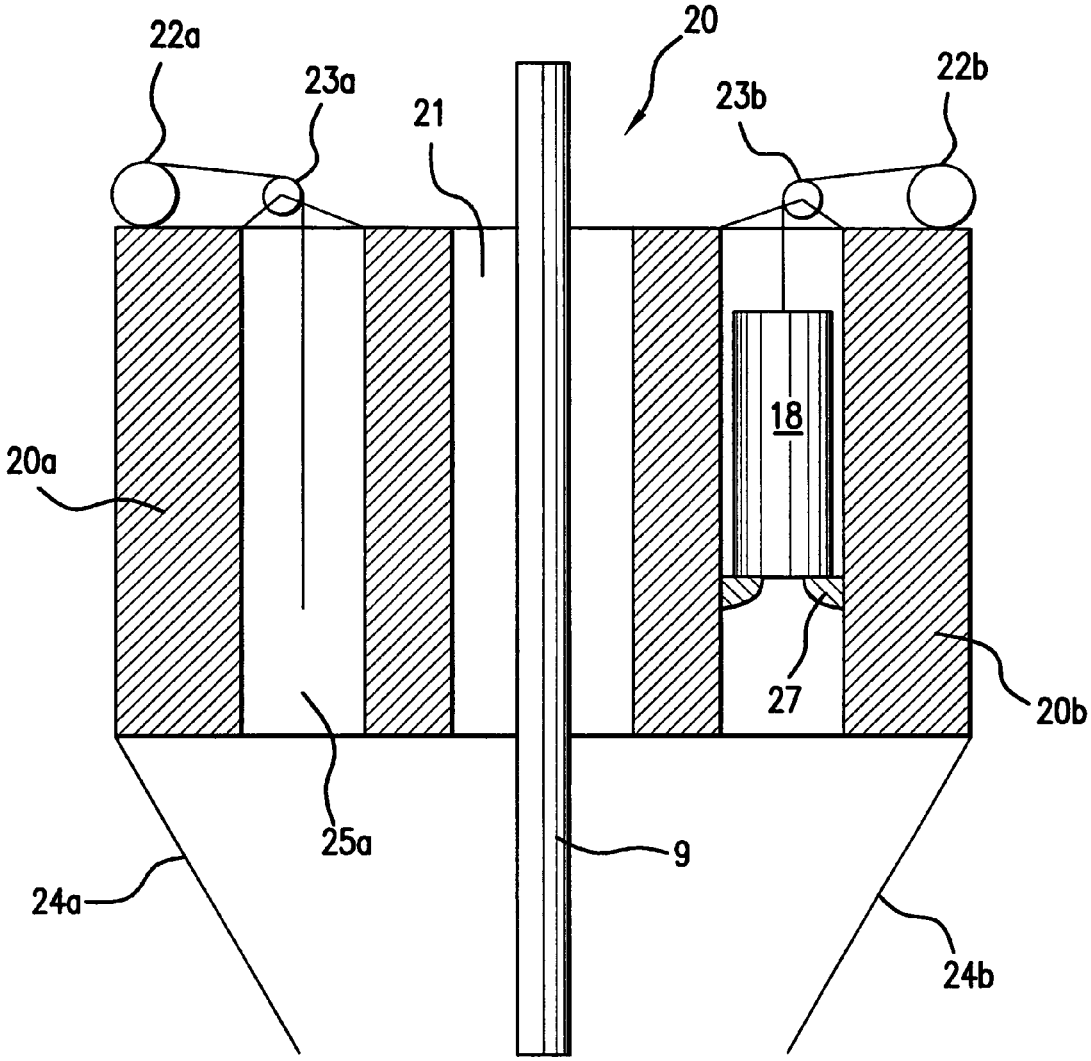
FIG. 9 is a vertical section through the device.
Figure 10:
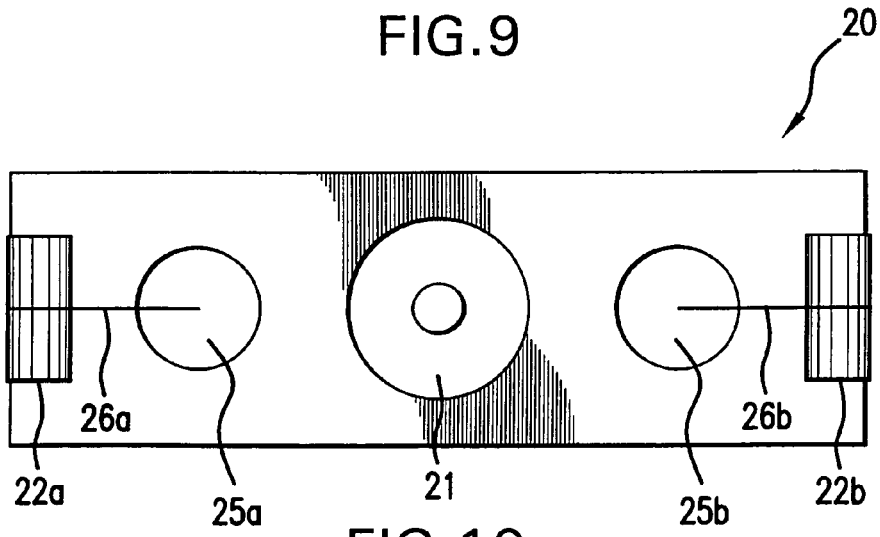
FIG. 10 is a plan view of the device.

The device 20, which is illustrated in more detail in FIGS. 9 and 10, is a square or box-shaped structure which essentially consists of one or more buoyancy elements and frame elements and stiffeners which are necessary for providing strength and rigidity. The buoyancy element is designed to give the device an approximately neutral or a small positive buoyancy in water when loaded.

In the box a number of vertical, through-going passages are provided. In a centrally arranged passage 21 there is a rod 9. The box has a limited movement relative to the rod. Two additional passages 25*a* and 25*b* are located on each side of the passage 21 and are intended for receiving modules or other equipment. On the top of the box there are mounted winches 22*a* and 22*b* with associated wires 26*a* and 26*b* which via blocks 23*a* and 23*b* can be inserted into their associated passage 25*a*, 25*b*. The winches may be electrically or hydraulically operated and can receive power from cables which accompany the wire. Alternatively, the winches may be operated by means of a ROV, either by being supplied with electric power via the ROV's power cable, or by the ROV's rotary tool being directly connected to the drive shaft on the winch.

The wires 26 are equipped with hooks or the like, thus enabling modules to be attached to the wires and permitting them to be arranged suspended inside the passage. In FIG. 9 a module 18 is illustrated suspended on the wire 26*b* in the passage 25*b*.

Alternatively, the passage may be equipped with retractable blocks or fingers 27 for securing the module 18 in the passage.

The passages 25 are thus arranged to act as storage spaces for modules which have to be placed on or retrieved from a seabed installation. The seabed installation is typically an oil well or a template and are indicated in FIG. 1 by 10. Equipment which has to be replaced may, for example, be a control module, an electric battery, an accumulator for storing hydraulic energy, a valve actuator or any other equipment employed in oil installations on the seabed.

In FIGS. 1 and 9 it can be seen that one storage space 25*a* is empty while a control module 18 is placed in the other 25*b*. The control module 18 has to be replaced by a control module 28 (FIG. 1) which is located on the seabed installation, and which is out of order or has to be retrieved for maintenance.

An ROV 8 is employed for monitoring the work and possibly for guiding the equipment into position.

In the preferred embodiment illustrated in FIG. 10, the box 20 has a rectangular basic shape (viewed from above). Other basic shapes are also possible, but it is advantageous to have basic shapes which make it possible to have an equal number of storage spaces, i.e. square, hexagonal, octagonal, etc., with the result that one storage space is empty, while that on the opposite side is in use. This enables modules to be replaced in one operation. It is also possible, however, to have other shapes such as circular.

The rod 9 is slidably arranged in the passage 21, thus permitting the box to move freely in a vertical direction relative to the rod. The device may be provided with guide lugs which interact with a groove in the rod, thus preventing it from rotating relative to the rod during use. At the bottom the rod 9 is equipped with a flange 11. When the device is freely suspended on the wire 4, its lower end will be supported on the flange 10.

At the bottom the rod 9 is equipped with a flange 11 with a diameter which is larger than the diameter of the passages 21. Chains 24*a* and 24*b* are attached to the flange 11 and the bottom of the box. This restricts the movement of the box up and down along the rod 9.

The box has a relatively large base, with the result that it has a high flow resistance in water. Since the rod is attached to the wire 4, it will move up and down in the water due to the vessel's movements. The box's flow resistance, together with its limited freedom of movement relative to the rod, cause it to be approximately stationary relative to the seabed. This design makes the use of expensive and complicated heave compensator devices on the vessel unnecessary, since heave compensation will be achieved with the described structure.

The method for replacing a module 28 located on a subsea installation will now be described with reference to FIGS. 1–8.

The device 20 is prepared on the vessel by passing the rod 9 into the box in the central passage 21. The chains (or lines) 24 are attached between the box and the flange as described earlier. A module is placed in one of the passages 25 and secured there either suspended on wires 26 or resting on the lugs 27. Finally, the wire 4 is attached to the rod's 9 upper end. By means of the crane 3 on the vessel the tool is raised from the deck and swung over the side of the boat in order to be lowered into the water. During this operation the tool rests on the flange 11.

When the device 20 is lowered into the water, the increasing flow resistance together with the buoyancy will cause the tool to slide upwards along the rod 9 until the movement is stopped by the chains 24. This is the situation illustrated in FIG. 1.

The lowering procedure is stopped a suitable distance from the seabed. When the crane 3 is stopped the rod 9 will move up and down in pace with the vessel's movements. The box's movements, however, will gradually stop on account of its greater inertia, as explained earlier. The box will come to rest approximately in the middle of the rod 9 as illustrated in FIG. 2. The box's buoyancy is calculated so that the weight of the module 18 and the chains 24 gives the box an approximately neutral buoyancy in the water. The winch 22*a* is operated either from the vessel or by means of ROV 8, as illustrated in FIG. 2.

In an alternative version, all the wire 26*a* is paid out from the winch 22*a*, as illustrated in FIG. 2. The ROV 8 will now leave the winch and move to the bottom of the device 20 to take hold of the end of the wire 26*a*. This end is provided with an attachment device, i.e. a hook or the like. The crane 3 is now caused to carefully lower the device 20 further, while the ROV guides the hook into engagement with an attachment means (ring or the like) on the module 28. As mentioned previously, the design of the device prevents the wave motion from being transferred to the box. This is the situation illustrated in FIG. 3.

After the wire 26*a* has been attached to the module 28, the crane 3 is again caused to raise the device some distance upwards. The module 28 will thereby be pulled up from the seabed installation and be freely suspended in the water, as illustrated in FIG. 4. The ROV now returns to the winch 22*a*. The winch 22*a* is started in order to lift the module up and into the passage 25*a*, cf. FIG. 4. The module 28 is now parked inside the box, see FIG. 5.

The device's 20 upwardly directed movement together with the box's increased weight due to the weight of the module have now caused the box once again to rest on the flange 11, as illustrated in FIGS. 4 and 5.

The ROV is now moved over to the winch 22*b*, causing it to lower the module 18 towards the seabed. The raising of the device has now resulted in the box resting on the flange. The box will thereby follow the upwardly directed wave motion, but will not follow the corresponding downwardly directed wave motion. The vessel's heave is thereby compensated for, even though the box now has a slightly negative buoyancy due to the additional weight created by the module 28.

Figures 6, 7, 8, 8B:
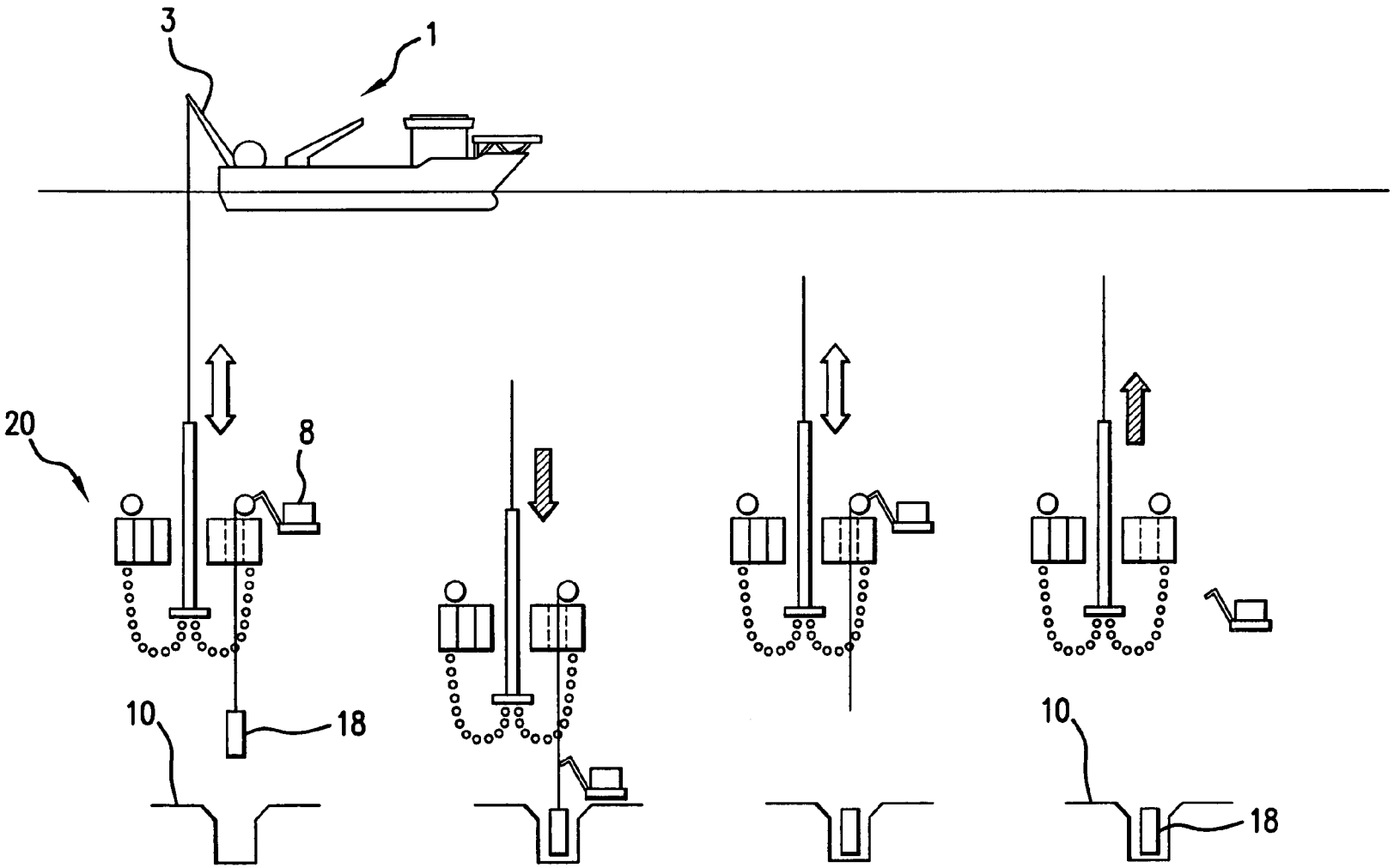

As illustrated in FIG. 7, the crane 3 is then caused to lower the whole device (with the module suspended underneath) down to the subsea installation. On account of the flow resistance the box will "remain suspended", thereby neutralising heave during the lowering procedure. The ROV guides the module into the correct position on the subsea installation. The ROV then releases the hook from the module, thus enabling the wire to be pulled up again. This is illustrated in FIG. 6. The device can now be pulled back up to the surface, as illustrated in FIG. 8.

In an alternative method, if the winch has a separate power supply, the device is kept at a distance above the seabed which is less than the length of the wires 26. The actions undertaken will thereby be in the order illustrated in FIGS. 1, 3, 7 and 8*b*.

It will be obvious to a person skilled in the art that other possibilities exist within the scope of the invention. For example, the box may be hexagonal, thereby taking three modules down for replacement. Another possibility is to connect opposite winches operatively together, with the result that when one winch pays out wire, the other winch will pull in wire. This offers the possibility of better balancing of the forces influencing the device.

In addition to the above described basic shapes, the box may also be cylindrical or be of any other shape which provides an optimal size relative to the number of storage spaces.

What is claimed is:

1. A method for replacing equipment on an installation (10) located on the seabed with a device (20) which has approximately neutral buoyancy in water and has storage spaces for equipment together with winches assigned to each storage space, the method comprising the steps wherein new equipment (18) is placed on one storage space (25*b*) while a second storage space (25*a*) is empty, the whole device is lowered to the seabed, the lowering procedure is stopped at a distance above the seabed, whereupon one winch device (22*a*) first pulls up old equipment (28) from the subsea installation and parks it on the vacant storage space (25*a*), whereupon a second winch device (22*b*) lowers the new equipment (18) for positioning on the subsea installation.

2. The method according to claim 1, wherein a first part of the device which comprises the storage spaces is kept stationary in the water, independently of the vessel's motion.

3. The method according to claim 2, wherein independent motion of the first part is achieved by the first part of the device being movable relative to a second part of the device that is attached to the vessel.

* * * * *